US012631040B2

(12) United States Patent
Huang et al.

(10) Patent No.: US 12,631,040 B2
(45) Date of Patent: May 19, 2026

(54) STRUCTURAL STRENGTHENING DEVICE

(71) Applicant: NATIONAL TAIPEI UNIVERSITY OF TECHNOLOGY, Taipei City (TW)

(72) Inventors: Chao-Hsun Huang, Taipei City (TW); Ea-Shin Lin, Taipei City (TW); Po-Cheng Lian, Hualien County (TW); Zhen-Jun Zheng, New Taipei City (TW)

(73) Assignee: NATIONAL TAIPEI UNIVERSITY OF TECHNOLOGY, Taipei City (TW)

( * ) Notice: Subject to any disclaimer, the term of this patent is extended or adjusted under 35 U.S.C. 154(b) by 189 days.

(21) Appl. No.: 18/660,334

(22) Filed: May 10, 2024

(65) Prior Publication Data

US 2024/0384554 A1 Nov. 21, 2024

(30) Foreign Application Priority Data

May 12, 2023 (TW) ..... 112117636

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04H 9/024; E04H 9/025; E04H 9/027; E04B 1/2403; E04B 2001/2409; E04B 2001/2421; E04B 2001/2433; E04B 2001/2445; E04B 2001/2448
USPC ..... 52/167.1, 648.1
See application file for complete search history.

(56) References Cited

U.S. PATENT DOCUMENTS 1,581,487 A * 4/1926 Gustavus ..... E04B 1/2403 52/648.1
1,915,023 A * 6/1933 Lizaso ..... E04B 1/2403 52/648.1
2,074,656 A * 3/1937 Luhl ..... E04D 3/14 49/495.1
2,720,291 A * 10/1955 Larkin ..... E04B 1/2403 403/169
3,977,801 A * 8/1976 Murphy ..... F16B 7/044 248/225.11

(Continued)

FOREIGN PATENT DOCUMENTS

CN 112982664 A * 6/2021 ..... E04B 1/2403

*Primary Examiner* — James M Ference
(74) *Attorney, Agent, or Firm* — WPAT, PC

(57) ABSTRACT

A structural strengthening device to improve lateral strength of a building frame. The structural strengthening device comprising a structural member, connected to two beam-column connectors, comprising two jacketing pieces and two buffering material fillers. By connecting adjacent columns in the building frame, resisting moments are generated at ends of the structural strengthening device during lateral deformation of the building frame, and bending moments and stresses at a base of the connected columns may be reduced. Implementation of the structural strengthening device reduces time and space required for structural rehabilitation of buildings, and the structural strengthening device is detachable to permit use the structural strengthening device as a temporary, reuseable or permanent rehabilitation structure.

20 Claims, 9 Drawing Sheets

(56) References Cited

U.S. PATENT DOCUMENTS 5,503,493 A * 4/1996 Kato ..... F16B 7/18 403/312
5,660,017 A * 8/1997 Houghton ..... E04H 9/024 52/283
6,138,427 A * 10/2000 Houghton ..... E04B 1/2403 52/655.1
6,516,583 B1 * 2/2003 Houghton ..... E04B 1/24 52/638
7,047,695 B2 * 5/2006 Allen ..... E04B 1/2403 52/656.9
7,178,296 B2 * 2/2007 Houghton ..... E04B 1/24 52/261
7,941,985 B2 * 5/2011 Simmons ..... E04B 1/24 52/655.1
9,080,339 B2 * 7/2015 Hayes ..... E04H 9/024
9,506,239 B2 * 11/2016 Houghton ..... E04H 9/024
10,006,219 B1 * 6/2018 Mehrain ..... E04H 9/027
10,094,103 B2 * 10/2018 Houghton ..... E04C 3/32
10,179,991 B2 * 1/2019 Houghton ..... E04H 9/021
10,900,215 B1 * 1/2021 Alrubaidi ..... E04H 9/024
2002/0124520 A1 * 9/2002 Bock ..... E04B 1/2403 52/655.1
2002/0184836 A1 * 12/2002 Takeuchi ..... E04C 3/04 52/289
2003/0041549 A1 * 3/2003 Simmons ..... E04B 1/2403 52/655.1
2004/0139683 A1 * 7/2004 Simmons ..... E04B 1/2403 52/719
2007/0079567 A1 * 4/2007 Leslie ..... E04B 1/24 52/297
2011/0252743 A1 * 10/2011 Yang ..... E04B 1/2403 52/849
2014/0083046 A1 * 3/2014 Yang ..... E04B 1/2403 52/704
2016/0356033 A1 * 12/2016 Houghton ..... E04B 1/2403
2018/0094419 A1 * 4/2018 Houghton ..... E04B 1/1903
2018/0223521 A1 * 8/2018 Uno ..... E04B 1/215
2018/0347222 A1 * 12/2018 Richards ..... E04H 9/021
2021/0140167 A1 * 5/2021 Adams ..... E04H 9/021
2024/0384554 A1 * 11/2024 Huang ..... E04H 9/021

* cited by examiner

STRUCTURAL STRENGTHENING DEVICE

FIELD OF THE INVENTION

The present application is a structural strengthening device which increases the lateral strength and stability of a structural frame by connecting adjacent columns in the frame.

BACKGROUND OF THE INVENTION

"Soft/weak story" is one of the most common structural irregularity in multistory buildings. This type of irregularity may cause serious damage or even collapse of buildings during an earthquake.

To improve both the strength and stability for this type of buildings, the device connects adjacent columns in the moment frame with a series of components. With the resisting moments generated by this device during lateral deformation of the structure, the bending moment at the base of the connected columns can be reduced during earthquakes (or wind).

SUMMARY OF THE INVENTION

The purpose of the present application is to provide a strengthening device to improve the lateral strength and stability of a building frame. This device connects adjacent columns in a moment-resisting frame with one or more structural members and rigid beam-column connectors at the beam-column joints. By providing additional resisting moments during lateral deformation of the structure, the bending moment at the base of the connected columns will be reduced during earthquakes (or wind).

Implementation of this device does not only reduce the time and space required for seismic rehabilitation of buildings, the "detachable" feature also allows the owner to use this device as a temporary (reusable) or permanent rehabilitation measure.

The beam-column connector mentioned above is formed by two jacketing pieces, buffering filler, and mechanical fasteners (optional). These connectors are designed to transfer the end moment generated by the connected structural member and can be removed and reused if handled properly.

To accomplish the above purpose, this device connects two (or more) adjacent columns, say, the "first column" and the "second column" (and the "third column", etc.), in a structural frame. The most basic components of this device is formed of a structural member and two beam-column connectors at both ends of the structural member. The "first beam-column connector" consists of two jacketing pieces, which form a complete metal sleeve to confine the "first column" when joined together through welds or mechanical fasteners, and buffering fillers. The "first jacketing piece" is comprised of a half sleeve mounted on the exterior face (the face not connected to the "first structural member" of this device) of the "first column", exterior flanges, and stiffening plates. The "second jacketing piece" has a similar construction except that it is mounted on the interior face of the "first column" with two of its flanges extended and connected to one end of the "first structural member". The "first buffering filler" and the "second buffering filler" fill the space between the "first jacketing piece" and the "first column" and the space between the "second jacketing piece" and the "first column", respectively. The "second beam-column connector" also consists of two joined jacketing pieces and buffering fillers. The "third jacketing piece" is comprised of a half sleeve mounted on the exterior face (away from the "first structural member" of this device) of the "second column", exterior flanges, and stiffening plates. The "fourth jacketing piece" has a similar construction except that it is mounted on the interior face of the "second column" with two of its flanges extended and connected to the other end of the "first structural member". The "third buffering filler" and the "fourth buffering filler" fill the space between the "third jacketing piece" and the "second column" and the space between the "fourth jacketing piece" and the "second column", respectively. The "first structural member" is then installed between the "first column" and the "second column" with one end connected to the "second jacketing piece" and the other end connected to the "fourth jacketing piece" to form a structural mechanism which can provide additional resisting moments during lateral deformation of the frame and thereby improve the lateral strength of the structure.

If mechanical fasteners are used to join the two jacketing pieces in the beam-column connector instead of welding, the connector can be quickly assembled on site to save the construction time and cost. In addition, it can be easily detached from the column without damaging the jacketing pieces, making it reusable in other projects.

According to an embodiment of the present application, the "first, second, third, and fourth jacketing pieces" mentioned above are all metal components.

According to an embodiment of the present application, the "first, second, third, and fourth buffering fillers" mentioned above can be made of non-shrinkage cement or other materials with similar functions.

According to an embodiment of the present application, the "first and second jacketing pieces" mentioned above are joined together to confine the "first column". The spaces between the "first and second jacketing pieces" and the "first column" provide the rooms for the "first and second buffering fillers".

According to an embodiment of the present application, the "third and fourth jacketing pieces" mentioned above are joined together to confine the "second column". The spaces between the "third and fourth jacketing pieces" and the "second column" provide the rooms for the "third and fourth buffering fillers".

According to an embodiment of the present application, the "first and second structural members" mentioned above could be either a steel, concrete, or wood beam.

According to an embodiment of the present application, the jacketing pieces mentioned above are equipped with 4 exterior flanges, or a flange set, each. The "first, second, third, and fourth flange sets" represent the flange sets in the "first, second, third, and fourth jacketing pieces" respectively.

According to an embodiment of the present application, the "first anchoring bolt set" must pass through the "first jacketing piece" and the "first buffering filler" before penetrating into the "first column" to provide temporary support for the installation of the "first jacketing piece". The "second anchoring bolt set" must pass through the "second jacketing piece" and the "second buffering filler" and penetrate into the "first column" to provide temporary support for installation of the "second jacketing piece".

According to an embodiment of the present application, the "third anchoring bolt set" must pass through the "third jacketing piece" and the "third buffering filler" before penetrating into the "second column" to provide temporary support for the installation of the "third jacketing piece". The "fourth anchoring bolt set" must pass through the "fourth jacketing piece" and the "fourth buffering filler" and penetrate into the "second column" to provide temporary support for installation of the "fourth jacketing piece".

According to an embodiment of the present application, if additional column(s), say, a third column, in the same frame is/are being strengthened with the same device with a "second structural member" connecting the "second and third columns", the strengthening device shall be constructed the same manner as for the "first structural member". For instance, the construction of the "third jacketing piece", which is now being connected to the "second structural member", shall be replaced by the one specified for the "second jacketing piece" and the "fifth and sixth jacketing pieces" shall be replaced by the "third and fourth jacketing pieces", respectively, are described earlier

DETAILED DESCRIPTION OF THE INVENTION

In order to show the functions, features, and construction of the present application clearly, the following description along with embodiments and accompanying figures is provided.

Figure 1:
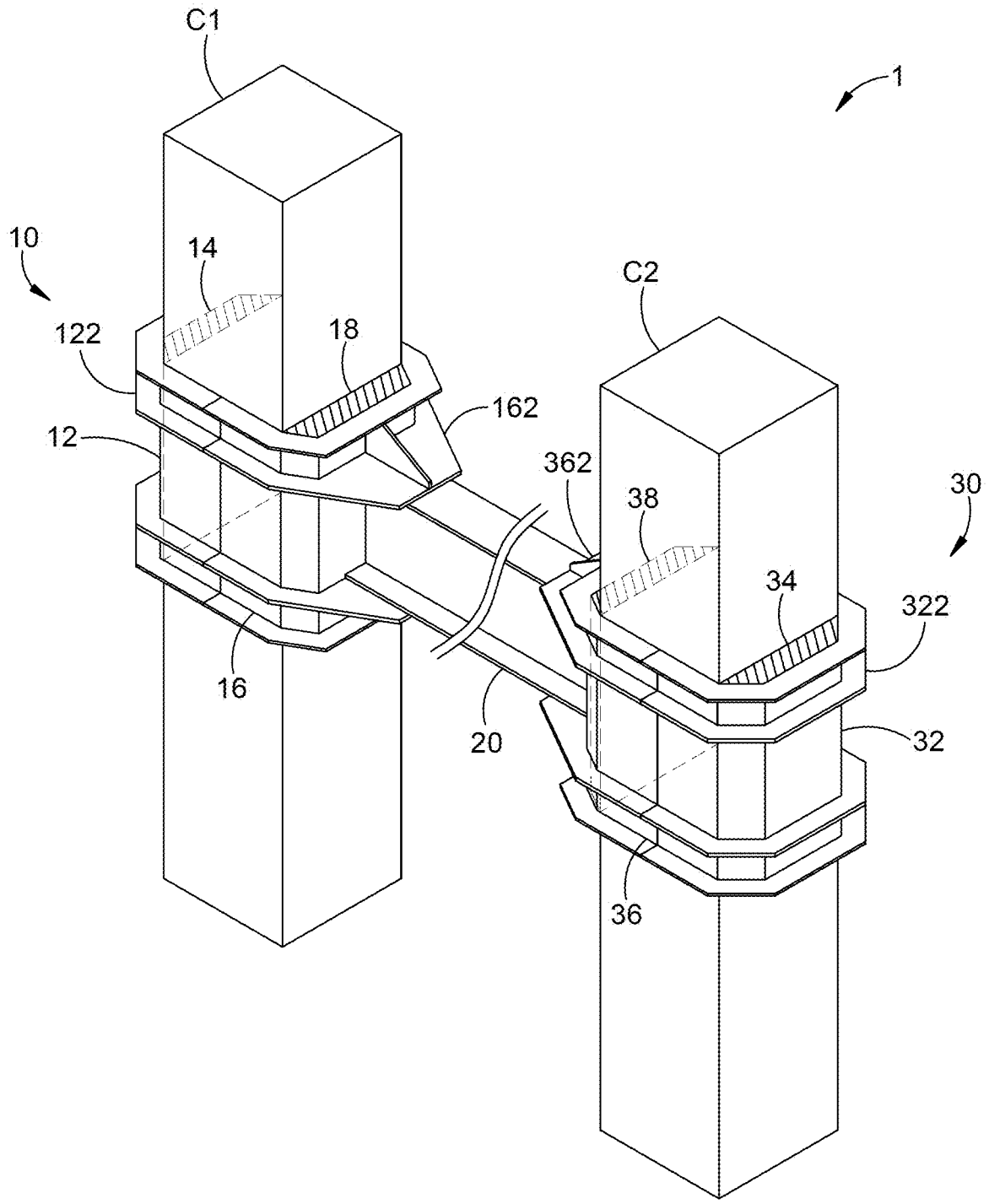
FIG. 1 shows a 3D view of the structural strengthening device and the columns according to an embodiment of the present application.
Figure 6:
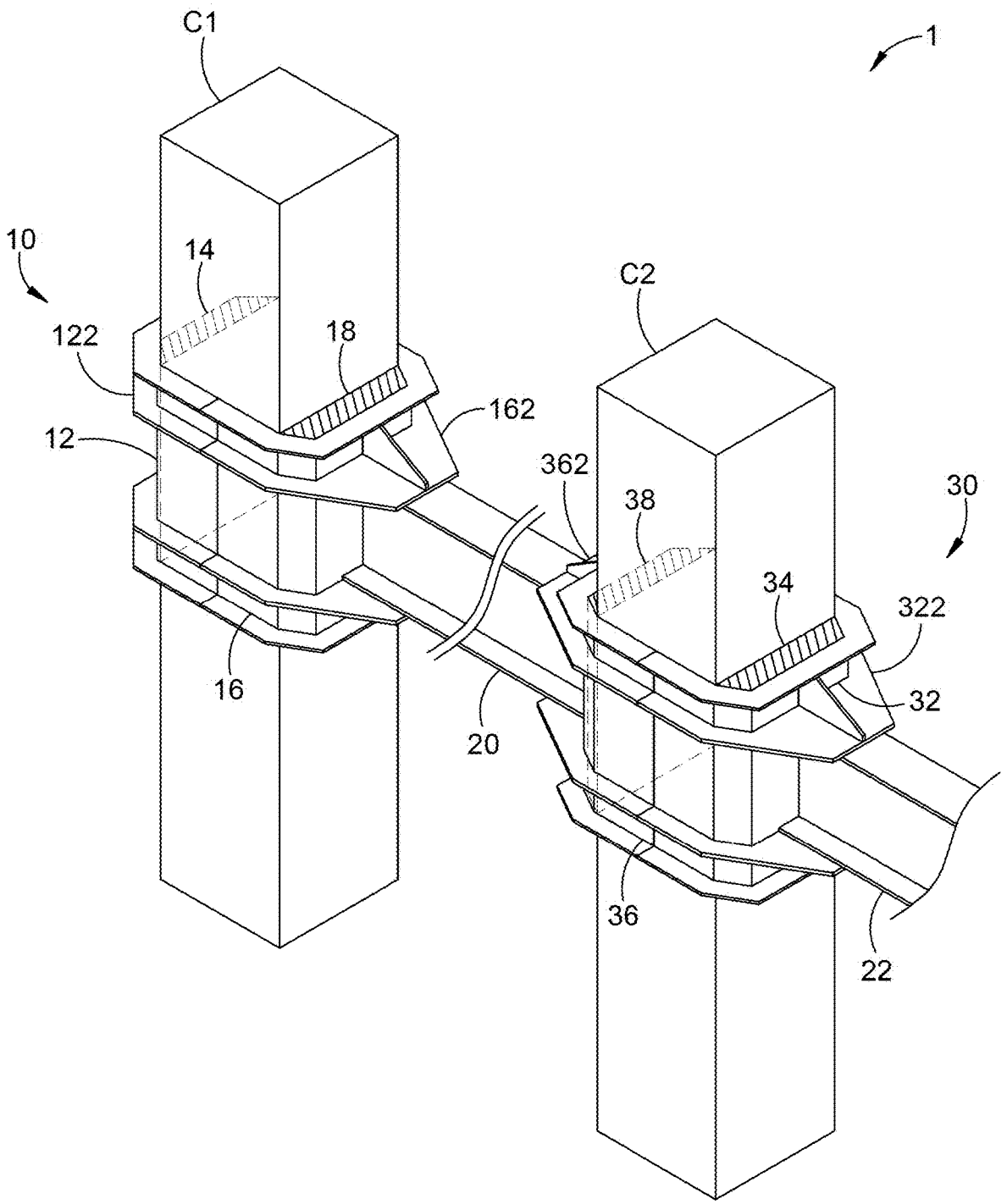
FIG. 6 shows a 3D view of the "second structural member" according to an embodiment of the present application.
Figure 7:
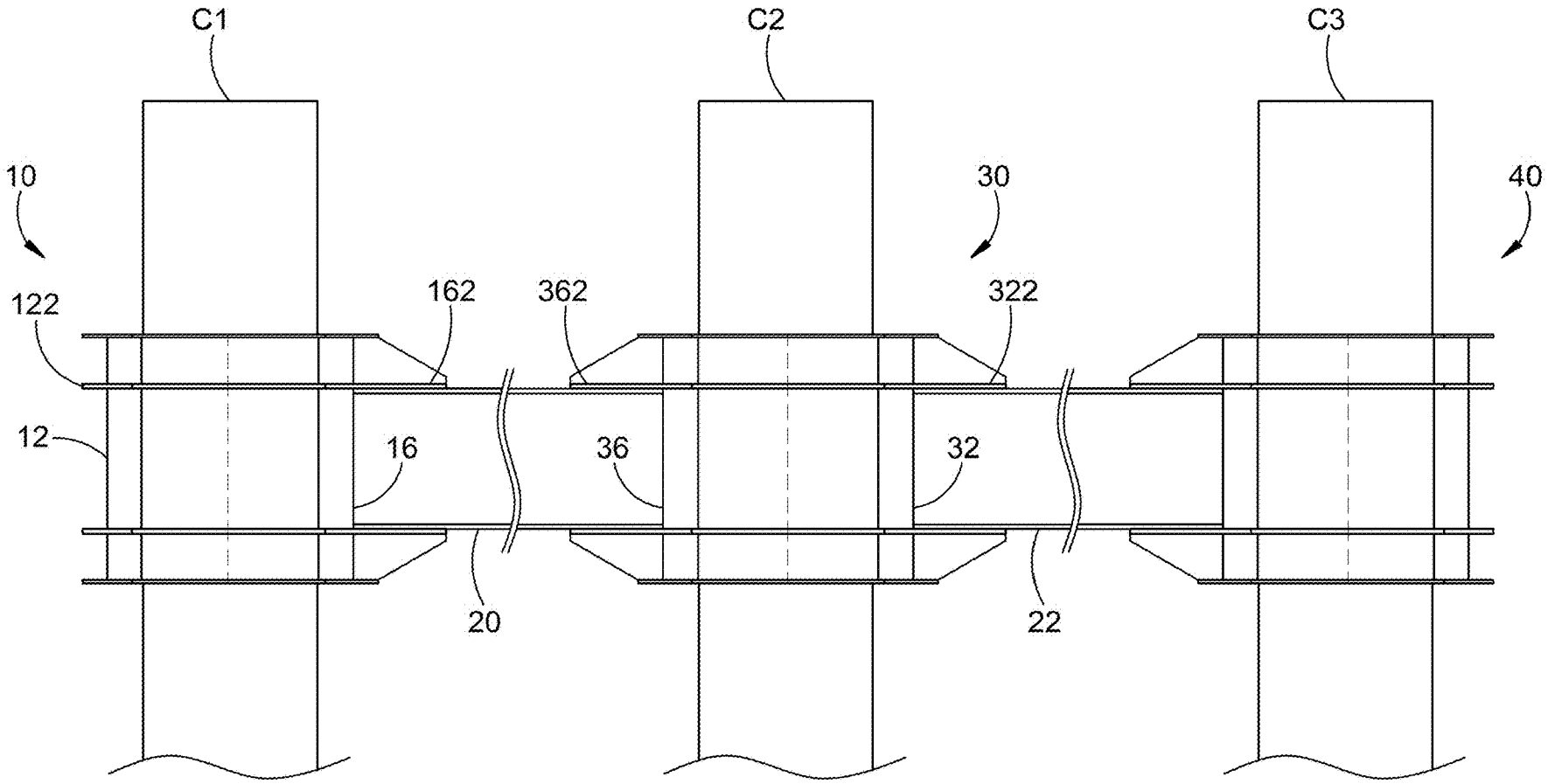
FIG. 7 shows a side view of the device connecting multiple columns in a frame according to an embodiment of the present application.

To improve the lateral strength of existing building structures, the present application provides a structural strengthening device which is formed by at least one structural member and two rigid beam-column connectors. Each beam-column connector consists of two jacketing pieces which transfer the bending moment generated at the end of the structural member to the connected column and two buffering fillers which dissipate the stress at the ends of the structural member to the surface of the column. The beam-column connectors are connected through a structural member (as shown in FIG. 1). If more than two columns are being strengthened, the above application can be extended as shown in FIGS. 6 and 7.

FIG. 1 shows a 3D view of the device. According to the present embodiment, one beam-column connector is provided for the "first column" C1 and the "second column" C2 each. The structural strengthening device 1 is formed by the "first beam-column connector" 10, the "first structural member" 20, and the "second beam-column connector" 30, as shown in the figure.

Figure 2:
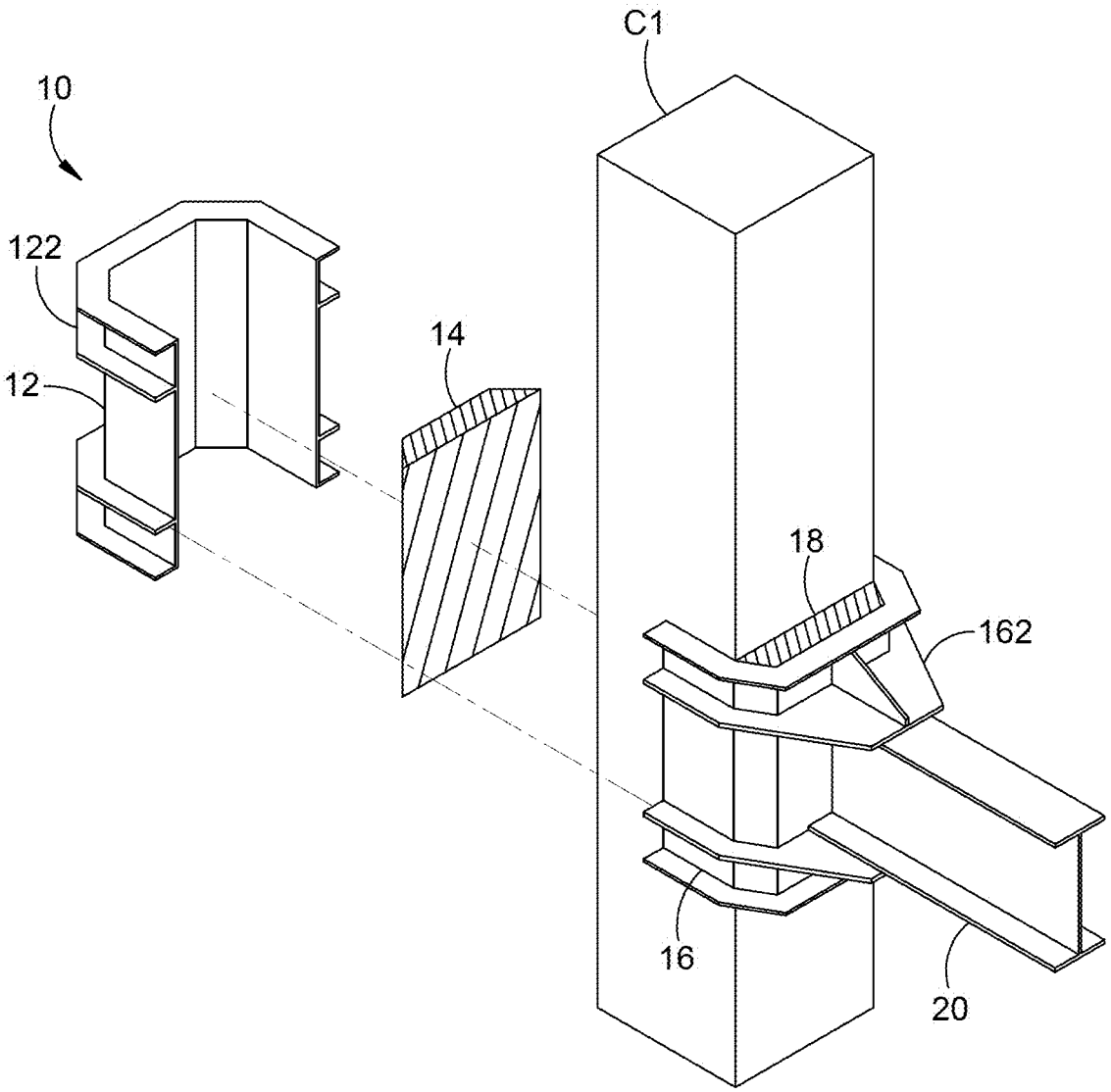
FIG. 2 shows an exploded view of this device around one of the strengthened columns according to an embodiment of the present application.
Figure 3:
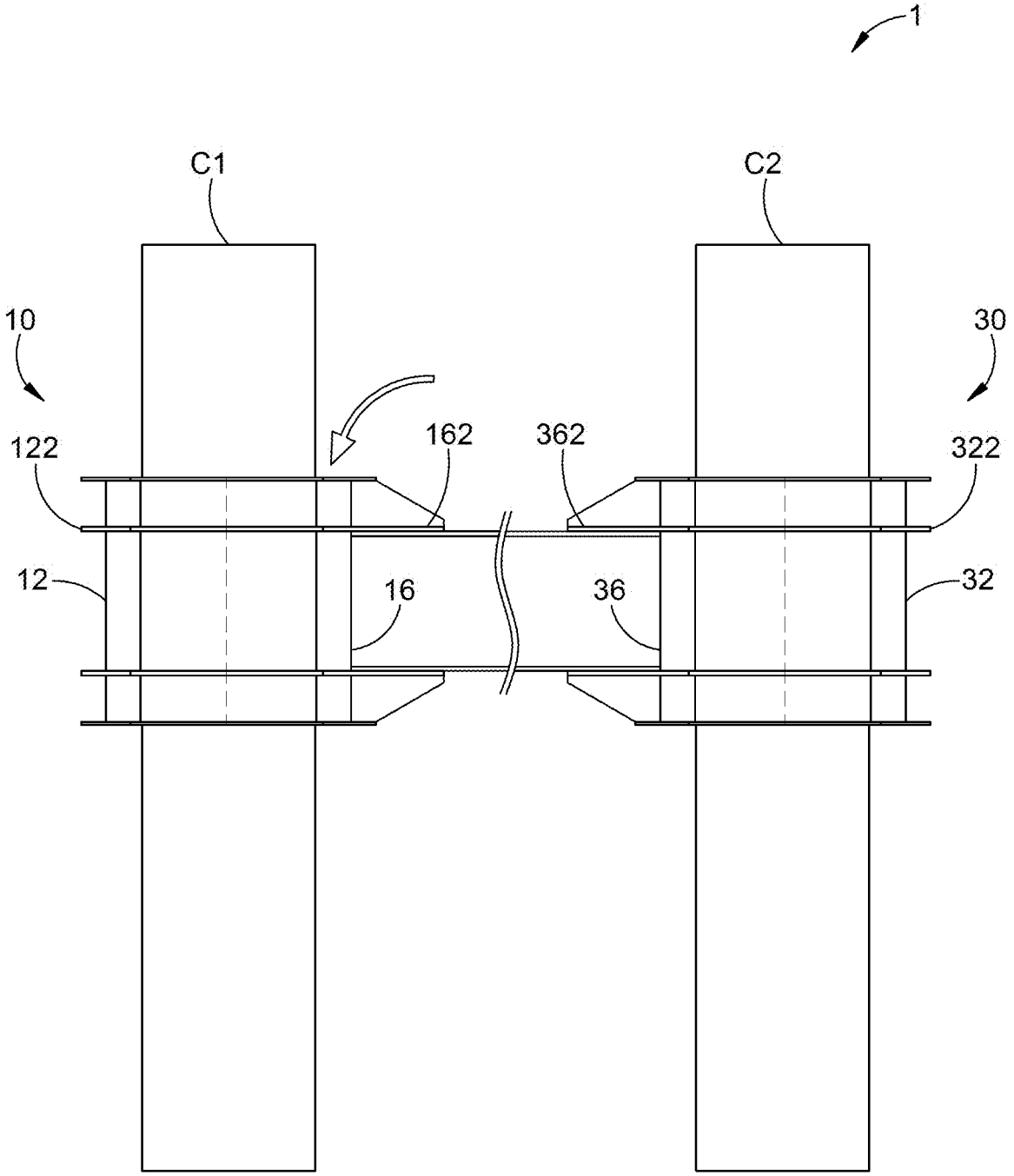
FIG. 3 shows a side view of the structure according to an embodiment of the present application.

FIG. 2 and FIG. 3 show an exploded and side views of the structure, respectively, according to an embodiment of the present application. The "first connector" 10 includes the "first jacketing piece" 12, the "first buffering filler" 14, the "second jacketing piece" 16, and the "second buffering filler" 18 according to the present embodiment. The "first jacketing piece" 12 is comprised of a half sleeve mounted on the exterior face (the face not connected to the "first structural member" 20 of this device) of the "first column" C1, exterior flanges 122, and stiffening plates. The "second jacketing piece" 16 has a similar construction except that it is mounted on the interior face of the "first column" C1 with two of its flanges 162 extended and connected to one end of the "first structural member" 20. The "first buffering filler" 14 and the "second buffering filler" 18 fill the space between the "first jacketing piece" 12 and the "first column" C1 and the space between the "second jacketing piece" 16 and the "first column" C1, respectively. The "second beam-column connector" 30 also consists of two joined jacketing pieces and buffering fillers. The "third jacketing piece" 32 is comprised of a half sleeve mounted on the exterior face (away from the "first structural member" 20 of this device) of the "second column" C2, exterior flanges 322, and stiffening plates. The "fourth jacketing piece" 36 has a similar construction except that it is mounted on the interior face of the "second column" C2 with two of its flanges extended and connected to the other end of the "first structural member" 20. The "third buffering filler" 34 and the "fourth buffering filler" 38 fill the space between the "third jacketing piece" 32 and the "second column" C2 and the space between the "fourth jacketing piece" 36 and the "second column" C2, respectively. The "first structural member" 20 is then installed between the "first column" C1 and the "second column" C2 with one end connected to the "second jacketing piece" 16 and the other end connected to the "fourth jacketing piece" 36 to form a structural mechanism which can provide additional resisting moments during lateral deformation of the frame and thereby improve the lateral strength of the structure.

According to the present embodiment, the "first jacketing piece" 12, the "second jacketing piece" 16, the "third jacketing piece" 32, and the "fourth jacketing piece" 36 in the beam-column connectors are all made of metal.

According to the present embodiment, the "first structural member" 20 could be either a steel, concrete, or wood beam. Nonetheless, the present application is not limited to the embodiment.

As shown in FIGS. 1~3, jacketing pieces 12, 16, 32, and 36 all contain an exterior flange set outside the metal sleeve, 122, 162, 322, and 362, respectively. These flanges are designed to transfer the flange stress of the "first structural member" 20 to the column, according to the present embodiment.

Figure 4:
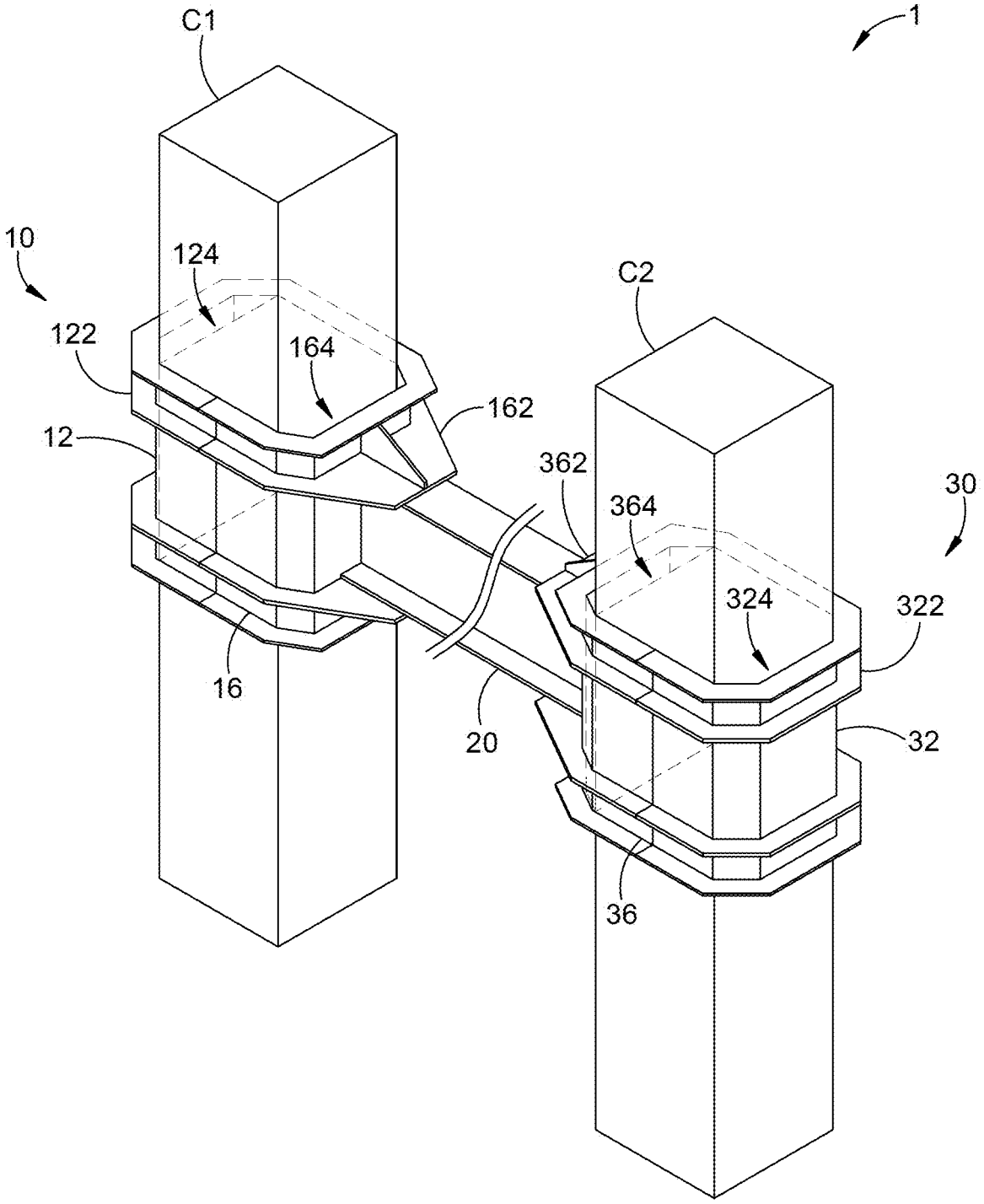
FIG. 4 shows a 3D view of the buffering space according to an embodiment of the present application.

FIG. 4 shows a 3D diagram of the buffering space. According to the present embodiment, the "first buffering space" 124 is the space between the "first jacketing piece" 12 and the "first column" C1, the "second buffering space" 164 is the space between the "second jacketing piece" 16 and the "first column" C1. The "third buffering space" 324 and the "fourth buffering space" 364 are the spaces between jacketing pieces 32, 36 and the second column C2, respectively. These buffering spaces are to be filled by buffer fillers.

The buffering filler may be non-shrinkage cement or other proper materials. The "first buffering filler" 14 fills the "first buffering space" 124, which is the space between the "first jacketing piece" 12 and the "first column" C1, the "second buffering filler" 18 fills the "second buffering space" 164, which is the space between the "second jacketing piece" 16 and the "first column" C1. The "third buffering filler" 34 fills the "third buffering space" 324, which is the space between the "third jacketing piece" 32 and the "second column" C2, and the "fourth buffering filler" 38 fills the "fourth buffering space" 364, which is the space between the "fourth jacketing piece" 36 and the "second column" C2.

Figure 5:
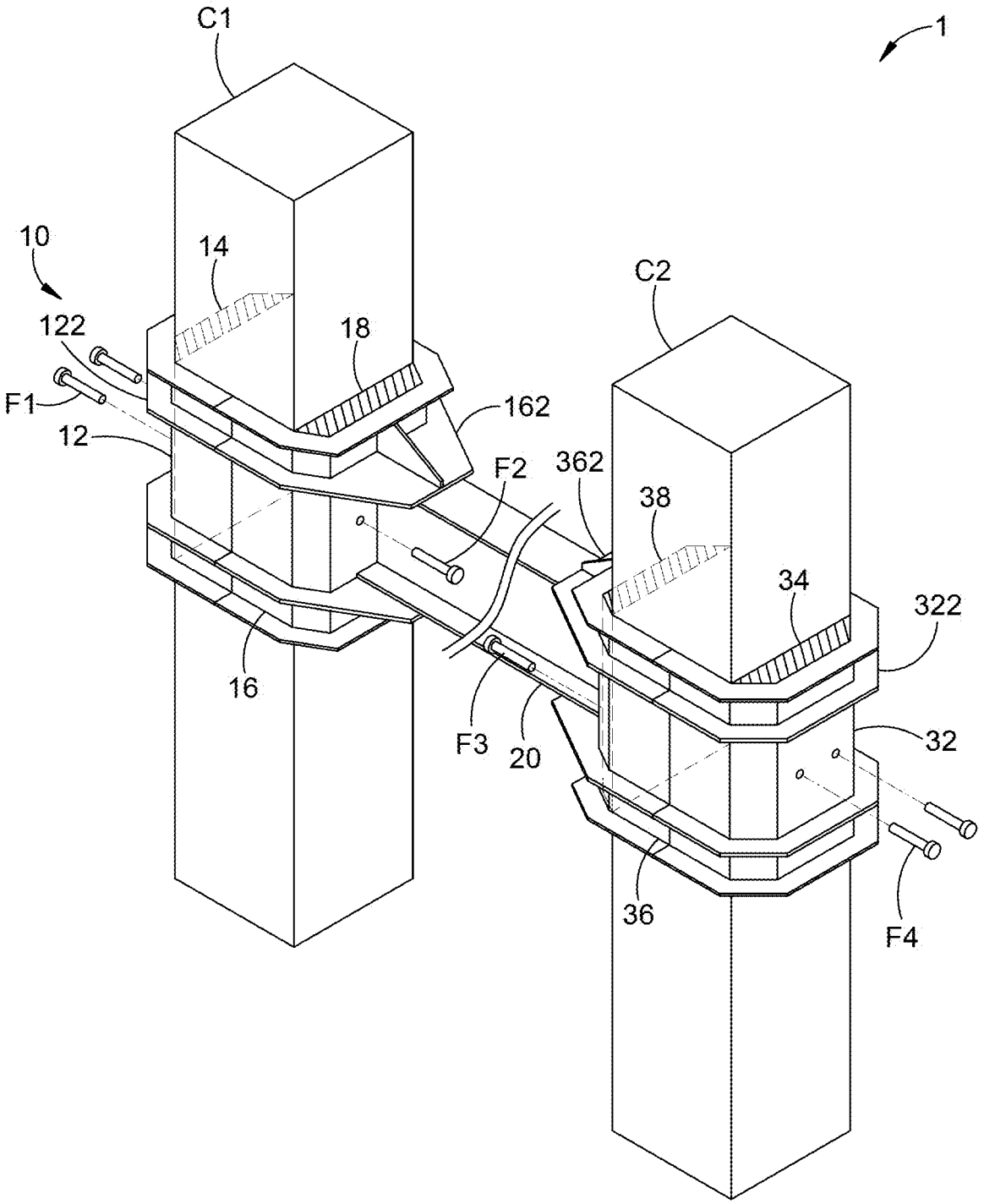
FIG. 5 shows a 3D view of the anchoring bolt installation according to an embodiment of the present application.

FIG. 5 shows a 3D diagram of anchoring bolt installation. According to an embodiment of the present application, the "first anchoring bolt set" F1 must pass through the "first jacketing piece" 12 and the "first buffering filler" 14 before penetrating into the "first column" C1 to provide temporary support for the installation of the "first jacketing piece" 12. The "second anchoring bolt set" F2 must pass through the "second jacketing piece" 16 and the "second buffering filler" 18 and penetrate into the "first column" C1 to provide temporary support for installation of the "second jacketing piece" 16.

According to an embodiment of the present application, the "third anchoring bolt set" F3 must pass through the "third jacketing piece" 32 and the "third buffering filler" 34 before penetrating into the "second column" C2 to provide temporary support for the installation of the "third jacketing piece" 32. The "fourth anchoring bolt set" F4 must pass through the "fourth jacketing piece" 36 and the "fourth buffering filler" 38 and penetrate into the "second column" C2 to provide temporary support for installation of the "fourth jacketing piece" 36.

FIGS. 6 and 7 shows the schematic diagrams of the device when a "second structural member" 22 is being installed to connect the "second column" C2 and a "third column" C3. As shown in the figures, one end of the "second structural member" 22 is connected to the "second beam-column connector" 30 while the other end is connected to the "third beam-column connector" 40, which provides rigid connection between the "second structural member" 22 and the "third column" C3 according to an embodiment of the present application. In an actual practice, the "third beam-column connector" 40 can be considered as a mirror structure of the "first beam-column connector" 10 and may be constructed using the procedure. The details will not be repeated here.

According to the present embodiment, the "second structural member" 22 could be either a steel, concrete, or wood beam. Nonetheless, the present application is not limited to the embodiment.

Construction details of the other components in this embodiment is the same as those of the first embodiment mentioned above, and therefore will not be described again.

Figure 8:
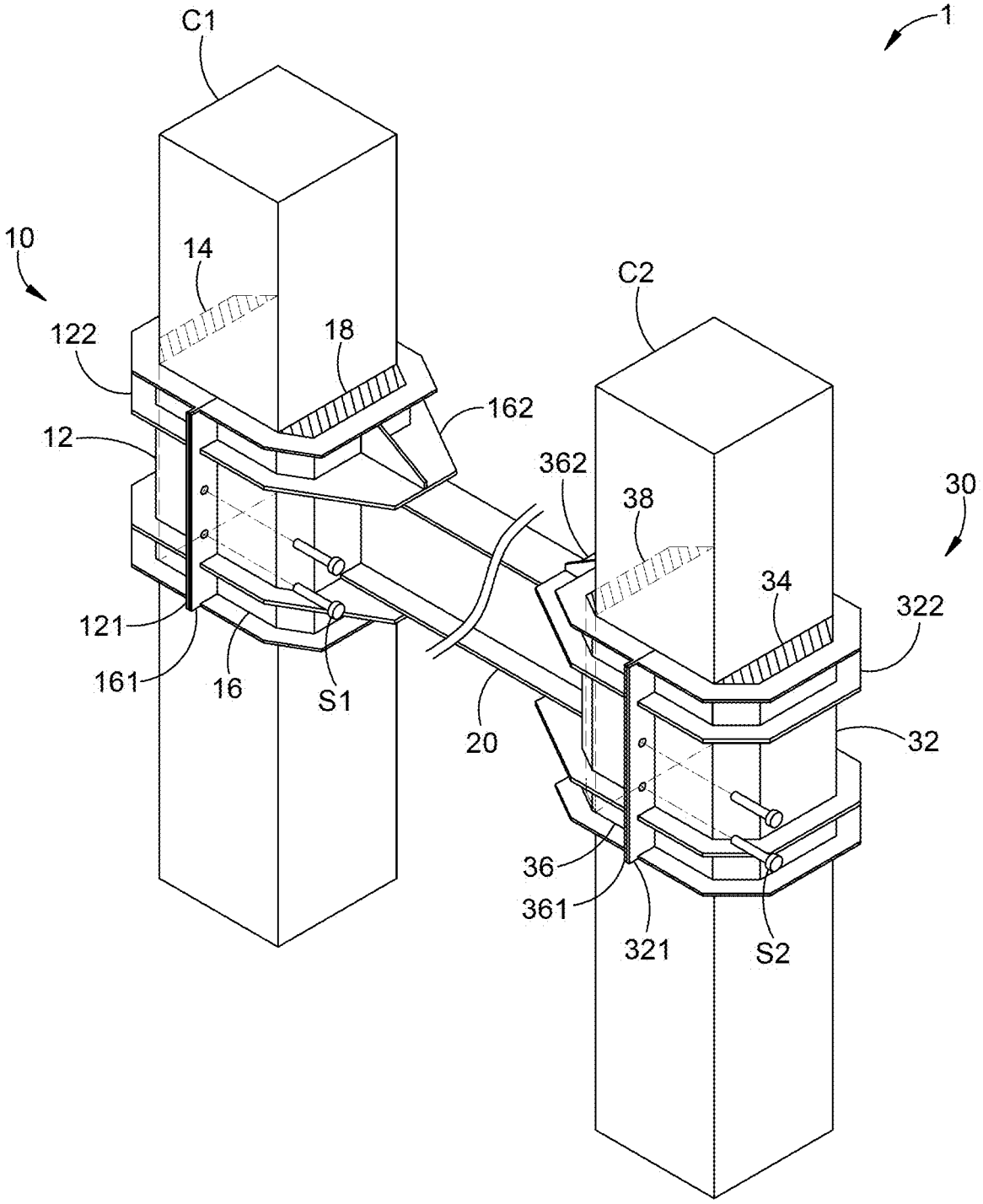
FIG. 8 shows a 3D view of the jacketing pieces joined by fasteners according to an embodiment of the present application.

FIG. 8 shows a second embodiment of the present application which is similar to the first embodiment. This device consists of a structural member and two beam-column connectors at both ends of the member. Both the "first beam-column connector" 10 and the "second beam-column connector" 30, installed at columns C1 and C2, respectively, are formed by two jacketing pieces joined with mechanical fasteners, and are connected by the "first structural member" 20.

Figure 9:
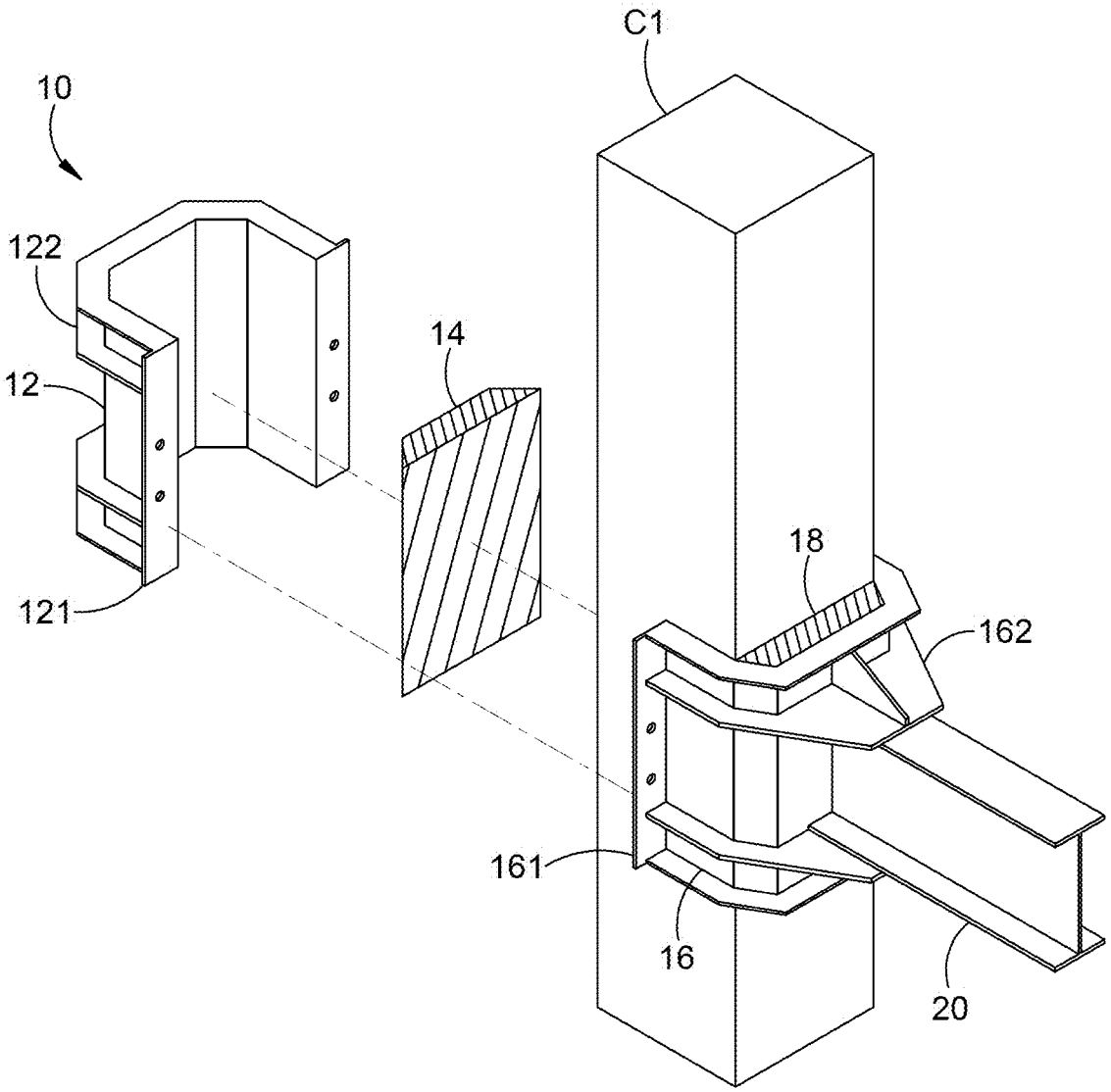
FIG. 9 shows an exploded view of the jacketing pieces joined by fasteners according to an embodiment of the present application.

FIG. 9 shows an exploded view of the detachable version of the device. According to the present embodiment, the "first beam-column connector" 10 consists of the "first jacketing piece" 12, the "first buffering filler" 14, the "second jacketing piece" 16, and the "second buffering filler" 18. The "first jacketing piece" 12, which comes with a "first connection plate 121" at both ends, is mounted on the exterior face of the "first column" C1. The "second jacketing piece" 16, which comes with a "connection plate 161" at both ends, is mounted on the interior face of the "first column" C1 with two of its flanges extended and connected to one end of the "first structural member" 20. The "second jacketing piece" 16 is joined together with the "first jacketing piece" 12 through "second connection plates 161" and "first mechanical fasteners" S1 to form a metal sleeve confining the "first column" C1. The "first buffering filler" 14 and the "second buffering filler" 18 fill the spaces between the "first column" C1 and the "first jacketing piece" 12 and the space between the "first column" C1 the "second jacketing piece" 16, respectively. The second "beam-column connector" 30 consists of the "third jacketing piece" 32, the "third buffering filler" 34, the "fourth jacketing piece" 36, and the "fourth buffering filler" 38. The "third jacketing piece" 32, which comes with a "third connection plate 321" at both ends, is mounted on the exterior face of the "second column" C2. The "fourth jacketing piece" 36, which comes with a "connection plate 361" at both ends, is mounted on the interior face of the "second column" C2 with two of its flanges extended and connected to one end of the "first structural member" 20. The "fourth jacketing piece" 36 is joined together with the "third jacketing piece" 32 through the "fourth connection plates 361" and "second mechanical fasteners" S2 to form a metal sleeve confining the "second column" C2. The "third buffering filler" 34 and the "fourth buffering filler" 38 fill the spaces between the "second column" C2 and the "third jacketing piece" 32 and the space between the "second column" C1 the "second jacketing piece" 36, respectively.

According to the present embodiment, the "first structural member" 20 is installed between the "first column" C1 and the "second column" C2 with one end connected to the "second jacketing piece" 16 and the other end connected to the "fourth jacketing piece" 36 to form a structural mechanism which can provide additional resisting moments during lateral deformation of the frame. In addition, both the "first beam-column connector" 10 and the "second beam-column connector" 30 can be detached from the jacketed columns easily by removing the "first mechanical fasteners" S1 and the "second mechanical fasteners" S2.

According to the present embodiment, the combination of connection plates 121, 161, 321, and 361 and mechanical fasteners S1 and S2 allows beam-column connectors 10 and 30 to be removed from the columns easily without damaging the beam-column connectors. Such feature makes the beam-column connectors reusable and allows it to serve either temporary or permanent strengthening purposes.

According to the present embodiment, the "first jacketing piece" 12, the "second jacketing piece" 16, the "third jacketing piece" 32, and the "fourth jacketing piece" 36 in the beam-column connectors are all made of metal.

According to the present embodiment, the strengthening device can also be used to connect another column, as shown in FIGS. 6 and 7. In such case, the two ends of the "second structural member" 22 will be connected to the "second beam-column connector" 30 and the "third beam-column connector" 40, which is a mirror structure of the "first beam-column connector" 10. Construction of the "third beam-column connector" 40 can be referred to that of the "first beam-column connector" 10, which will not be repeated here.

The construction details of the other components in this embodiment are almost the same as those in the first embodiment, which have been described previously and therefore will not be repeated.

As a summary, the present application provides a structural strengthening device which connects adjacent columns in a structural frame with at least one structural members and two beam-column connectors. Such device is aimed to improve the strength and stability of the structural system under lateral loads. The beam-column connectors used in this device adopts a detachable design, which allows these connectors to be reused after removal. Such feature does not only shorten the time and space required for the rehabilitation construction, but also allow the building owner to use it as a temporary or permanent strengthening measure.

The present application conforms to the legal requirements owing to its novelty, nonobviousness, and practical functions. However, the foregoing description is only applicable to the embodiments of the present application, not intended to limit the scope and range of the present application. Those equivalent changes or modifications made according to the shape, structure, feature, or spirit described in the claims of the present application are included in the appended claims of the present application.

The invention claimed is:

1. A structural strengthening device, for a connection of a first column and a second column, comprising:

a first beam-column connector, comprising a first jacketing piece, mounted on an exterior side of the first column;

a first buffering filler, filling up a space between the first column and the first jacketing piece;

a second jacketing piece, mounted on an interior side of the first column and joined together with to the first jacketing piece to form a complete column jacket; and a second buffering filler, filling up a space between the first column and the second jacketing piece;

a first structural member, one of two ends thereof connected with the second jacketing piece;

a second beam-column connector, comprising:

a third jacketing piece, mounted on an exterior side of the second column;

a third buffering filler, filling up a space between the second column and the third jacketing piece;

a fourth jacketing piece, mounted on an interior side of the second column and joined together with to the third jacketing piece to form a complete column jacket; connected to the other end of two ends of the first structural member;

a fourth buffering filler, filling up a space between the second column and the fourth jacketing piece;

a first anchoring bolt set, passing through the first jacketing piece and the first buffering filler, and inserting into the first column; and a second anchoring bolt set, passing through the second jacketing piece and the second buffering filler, and inserting into the first column.

2. The structural strengthening device of claim 1, wherein the first jacketing piece, the second jacketing piece, the third jacketing piece, and the fourth jacketing piece are each made of metal.

3. The structural strengthening device of claim 1, wherein the first buffering filler, the second buffering filler, the third buffering filler, and the fourth buffering filler are each made of non-shrinkage grout or other materials with a similar function.

4. The structural strengthening device of claim 1, wherein the first jacketing piece and the second jacketing piece confine the first column; a first buffering space is formed between the first jacketing piece and the first column; a second buffering space is formed between the second jacketing piece and the first column; the first buffering filler fills the first buffering space; and the second buffering filler fills the second buffering space.

5. The structural strengthening device of claim 1, wherein the third jacketing piece and the fourth jacketing piece confine the second column; a third buffering space is formed between the third jacketing piece and the second column; a fourth buffering space is formed between the fourth jacketing piece and the second column; the third buffering filler fills the third buffering space; and the fourth buffering filler fills the fourth buffering space.

6. The structural strengthening device of claim 1, wherein the first structural member is either a steel, concrete, or wood beam.

7. The structural strengthening device of claim 1, wherein the first jacketing piece includes a first flange set on an exterior side, and the second jacketing piece includes a second flange set on an exterior side.

8. The structural strengthening device of claim 1, wherein the third jacketing piece includes a third flange set on an exterior side and the fourth jacketing piece includes a fourth flange set on an exterior side.

9. The structural strengthening device of claim 1, further comprising a third anchoring bolt set, passing through the third jacketing piece and the third buffering filler, and inserting into the second column, and a fourth anchoring bolt set, passing through the fourth jacketing piece and the fourth buffering filler, and inserting into the second column.

10. The structural strengthening device of claim 1, further comprising a second structural member, one end thereof connected to the third jacketing piece.

11. A structural strengthening device, for a connection of a first column and a second column, comprising:

a first beam-column connector, comprising a first jacketing piece, mounted on an exterior side of the first column, with a first connection plate at both ends;

a first buffering filler, filling up a space between the first column and the first jacketing piece;

a second jacketing piece, mounted on an interior side of the first column, joined together with the first jacketing piece by connecting the first and second connection plates using the first mechanical fasteners; and a second buffering filler, filling up a space between the first column and the second jacketing piece;

a first structural member, one of two ends thereof connected with one side of second jacketing piece;

a second beam-column connector, comprising:

a third jacketing piece, mounted on an exterior side of the second column, with a third connection plate at both ends;

a third buffering filler, filling up a space between the second column and the third jacketing piece;

a fourth jacketing piece, mounted on an interior side of the second column, joined together with to the third jacketing piece by connecting the third and fourth connection plates using the second mechanical fasteners, and connected to the other end of two ends of the first structural member;

a fourth buffering filler, filling up a space between the second column and the fourth jacketing piece;

a first anchoring bolt set, passing through the first jacketing piece and the first buffering filler, and inserting into the first column; and a second anchoring bolt set, passing through the second jacketing piece, the second buffering filler, and inserting into the first column.

12. The structural strengthening device of claim 11, wherein the first jacketing piece, the second jacketing piece, the third jacketing piece, and the fourth jacketing piece are each made of metal.

13. The structural strengthening device of claim 11, wherein the first buffering filler, the second buffering filler, the third buffering filler, and the fourth buffering filler are made of non-shrinkage grout or other materials with a similar function.

14. The structural strengthening device of claim 11, wherein the first jacketing piece and the second jacketing piece confine the first column; a first buffering space is formed between the first jacketing piece and the first column; a second buffering space is formed between the second jacketing piece and the first column; the first buffering filler fills the first buffering space; and the second buffering filler fills the second buffering space.

15. The structural strengthening device of claim 11, wherein the third jacketing piece and the fourth jacketing piece confine the second column; a third buffering space is formed between the third jacketing piece and the second column; a fourth buffering space is formed between the fourth jacketing piece and the second column; the third buffering filler fills the third buffering space; and the fourth buffering filler fills the fourth buffering space.

16. The structural strengthening device of claim 11, wherein the first structural member is either a steel, concrete, or wood beam.

17. The structural strengthening device of claim 11, wherein the first jacketing piece includes a first flange set on an exterior side, and the second jacketing piece includes a second flange set on an exterior side.

18. The structural strengthening device of claim 11, wherein the third jacketing piece includes a third flange set on an exterior side, and the fourth jacketing piece includes a fourth flange set on an exterior side.

19. The structural strengthening device of claim 11, further comprising a third anchoring bolt set, passing through the third jacketing piece and the third buffering filler, and inserting into the second column, and a fourth anchoring bolt set, passing through the fourth jacketing piece and the fourth buffering filler, and inserting into the second column.

20. The structural strengthening device of claim 11, further comprising a second structural member, one end thereof connected to the third jacketing piece.

* * * * *